US006173790B1

(12) United States Patent
Russwurm et al.

(10) Patent No.: US 6,173,790 B1
(45) Date of Patent: Jan. 16, 2001

(54) PROCESS AND DEVICE FOR ATOMIZING LIQUID EXTINGUISHING AGENTS IN STATIONARY EXTINGUISHING INSTALLATIONS

(75) Inventors: Manfred Russwurm, Bad Schwartau (DE); Frederic Aebischer, Luterbach (CH)

(73) Assignees: Minimax GmbH, Bad Oldesloe (DE); ASEA Brown Boveri AG, Baden (CH)

( * ) Notice: Under 35 U.S.C. 154(b), the term of this patent shall be extended for 0 days.

(21) Appl. No.: 09/155,625

(22) PCT Filed: Mar. 26, 1997

(86) PCT No.: PCT/EP97/01550

§ 371 Date: Sep. 30, 1998

§ 102(e) Date: Sep. 30, 1998

(87) PCT Pub. No.: WO99/36651

PCT Pub. Date: Oct. 9, 1997

(30) Foreign Application Priority Data

Mar. 30, 1996 (EP) ..... 96105159
Sep. 12, 1996 (EP) ..... 96114586

(51) Int. Cl.[7] ..... A62C 2/00

(52) U.S. Cl. ..... 169/44; 169/15; 169/60; 169/46; 239/310; 239/398

(58) Field of Search ..... 169/37, 14, 15, 169/44, 46, 56, 60, 61, 16; 239/10, 310, 398, 407, 548, 452, 453, 464, 533.1, 571

(56) References Cited

U.S. PATENT DOCUMENTS 3,592,270 * 7/1971 Livingston ..... 239/571
4,585,173 * 4/1986 Soule ..... 239/453
5,464,065 * 11/1995 Kaylor ..... 169/44
5,764,716 * 6/1998 Eckardt ..... 169/44 X

FOREIGN PATENT DOCUMENTS

1326282 * 7/1985 (SU) .

OTHER PUBLICATIONS

Portola, V. A., Underground fire–fighting procedure–mixing components of extinguishing liquid and freezing with inert gas, Derwent, see abstract, Jul. 1985.*

Charkov et al, Making inert foam by feeding nitrogen into foamable solution–using liquid nitrogen in specified ratio to stabilise foam, Derwent, see abstract, Mar. 1977.*

* cited by examiner

*Primary Examiner*—Andres Kashnikow
*Assistant Examiner*—Steven J. Ganey
(74) *Attorney, Agent, or Firm*—Cohen, Pontani, Lieberman & Pavane

(57) ABSTRACT

A process and a device for atomization of a liquid extinguishing medium, in which the liquid extinguishing medium and a liquid inert gas are mixed in a mixing unit to form a liquid extinguishing medium mixture. The mixture is conveyed through a conduit to a distributing device such as extinguishing nozzles. As the mixture exits the distributing device the mixture is atomized, forming an aerosol spray for extinguishing a fire within an extinguishing area defined by the aerosol spray. A detector arranged in the extinguishing area for detection of parameters relating to extinguishing of the fire is connected to an evaluation device which in turn is connected to a control valve. The control valve regulates the quantity of liquid inert gas supplied to the mixing unit.

12 Claims, 1 Drawing Sheet

PROCESS AND DEVICE FOR ATOMIZING LIQUID EXTINGUISHING AGENTS IN STATIONARY EXTINGUISHING INSTALLATIONS

BACKGROUND OF THE INVENTION

1. Field of the Invention

The present invention relates to a process and a device for mixing liquid inert gas with a liquid extinguishing medium (e.g., water) and for subsequent atomization of the mixture for the purpose of fire fighting. The present invention is suitable for stationary, and mobile, fire extinguisher units.

2. Description of the Related Art

Usually, sprinkler, foam, water spray and gas extinguisher units are used for extinguishing fires.

These extinguisher units have disadvantages for particular applications. For example, a great deal of water is used in sprinkler and water spray extinguisher units. This can lead to considerable damage. Moreover, large supplies of water and machine outputs must be installed. Foam extinguisher units entail increased technical expense, and this leads to high installation costs. High costs for disposal are also incurred. Gas extinguisher units, which work, for example, by lowering the oxygen concentration by means of inertization in the extinguishing area, require considerable safety expenditure, particularly in the case of $CO_2$ extinguisher units, due to the danger to personnel. Certain other extinguishing gases that were previously used, e.g., halon, can no longer be used due to legal restrictions. Other extinguishing mediums, e.g., argon, are relatively expensive.

Reference WO95/24274 discloses a process and a device for atomizing liquid extinguishing medium with a feed for extinguishing medium, a distributing device for gas, a reservoir and a mixing unit. The referenced process functions with a plug flow, which does not assume a pulsing character until the nozzle exit. Moreover, at the mixing unit, the two media have the same pressure, because the gaseous medium from the container is used as a propellant for the extinguishing medium. The use of liquid inert gas is not described.

SUMMARY OF THE PRESENT INVENTION

An object of the present invention is to reduce, particularly in a stationary water spray extinguisher unit, the amount of liquid extinguishing medium, as commonly used in a conventional extinguisher units, needed to extinguish a fire.

This object is attained by adding an inert gas in liquid form to the liquid extinguishing medium upstream of a nozzle producing a liquid extinguishing medium mixture. Here, the term "inert gas" does not refer to an aggregate state at the time of addition to the liquid extinguishing medium; rather, the inert gas is preferably added as a liquid to the liquid extinguishing medium.

The addition of the liquid inert gas can be carried either by mixing in the liquid inert gas at an increased pressure relative the liquid extinguishing medium, or by adding the liquid extinguishing medium at an increased pressure relative to the liquid inert gas.

The liquid extinguishing medium typically water, is usually conducted in a conduit network at a pressure of 8–10 bar, regardless of the water source, e.g., municipal water network, water tanks, etc.

Advantageously, the liquid inert gas is fed to the conduit network at a higher pressure. This leads, in conjunction with suitable mixing devices and devices for controlling the pressure in the conduit network (e.g., non-return valves, blocking valves, media control valves), to an increase in pressure at a device for distributing the liquid extinguishing medium mixture, e.g., the nozzle. Typically, the distributing device includes several nozzles.

As a result of the increased pressure, at the nozzles, there is an increase not only in the water exit velocity, but also in the droplet distribution and the range.

Droplet size and the range are influenced by means of different nozzles. Specifically, ranges of up to 10 m can be attained.

Preferably, the liquid inert gases and $CO_2$, the liquid extinguishing medium, is water.

It should be noted that a two-phase bubble flow is produced by the inventive process, in that more inert gas is added than can go into solution. This two-phase bubble flow in the tubular conduit system in a simple fashion produces at the nozzle an aerosol with optimal droplet size for fire fighting.

One advantage of the present invention is that the liquid inert gas largely dissolves in the liquid extinguishing medium under high pressure and is conveyed to the fire by means of the produced droplets, since a dynamic process of degasification takes longer than the transport time. This improves the extinguishing effect, because the droplets split again en route to the fire. Advantageously, the fire is better extinguished with the very fine water mist that is produced.

Although the physical-chemical processes are not yet fully understood, it has been determined that, due to the process according to the invention, the flame is separated from a combustible gas by the kinetic energy of the liquid extinguishing medium and by the degasification of the inert gas at the location of the fire.

As a result of the formation of micro-droplets in the area of the fire, particularly due to the separation of the liquid extinguishing medium and the inert gas, the surface of the liquid extinguishing medium is considerably enlarged. In addition, the inert gas (e.g., $CO_2$) absorbs radiated energy, and vaporization of the liquid extinguishing medium removes energy from the fire. In this way, energy surplus in an area of the fire is reduced so far that a high extinguishing effect, which could not be attained solely by the use of micro-droplets without the mixing in of preferably liquid inert gas, is attained.

The amount of inert gas added is optimized. When $CO_2$ is used, as preferred, optimization can be carried out during projecting, in that a maximum quantity of $CO_2$ relative to the object being extinguished is determined.

It is preferable, however, to control the amount of the inert gas, in particular, the liquid inert gas, e.g., $CO_2$, added in dependence on a concentration of the inert gas in the extinguishing area during the extinguishing, so that a maximum MAK value of 10,000 ppm or the maximum value usual in inergenic extinguisher units (<4% by volume) is not exceeded.

According to a further preferred process, the amount of liquid inert gas added is also controlled based on the course of the fire.

The object is further attained by means of a device according to the invention, which, includes the supply for the liquid extinguishing medium and the distributing devices for the liquid extinguishing medium, mixture. The device has a reservoir for the liquid inert gas and a mixing unit for mixing the liquid extinguishing medium and the liquid inert gas. This special mixing unit is preferably mounted horizontally or vertically upstream of the nozzles in the tubular conduit network.

Preferably, the device is connected to a detector to determine the concentration of the inert gas in the extinguishing area. The detector is connected to an evaluation device, which is connected to a control device to control the amount of the liquid inert gas.

Also preferred is a device wherein a detector is arranged to determine the course of the fire.

In another embodiment, this detector forms a unit with the detector that determines the concentration of the inert gas in the extinguishing area. The unit is embodied, in particular, as a combined measurement device for electro-magnetic radiation as well as on the principle of smoke alarms and heat alarms.

In a further preferred embodiment of the present invention opening angles of the distributing devices for the liquid extinguishing medium mixture are adjustable, whereby the opening angles are determined by the quantity of mixed-in liquid inert gas. The process and device according to the invention are described in greater detail in reference to a schematic drawing of an example.

The various features of novelty which characterize the invention are pointed out with particularity in the claims annexed to and forming a part of the disclosure. For a better understanding of the invention, its operating advantages, and specific objects attained by it uses, reference should be had to the drawing and descriptive matter in which there are illustrated and described preferred embodiments of the invention.

DETAILED DESCRIPTION OF PRESENT PREFERRED EMBODIMENTS

Figure 1:
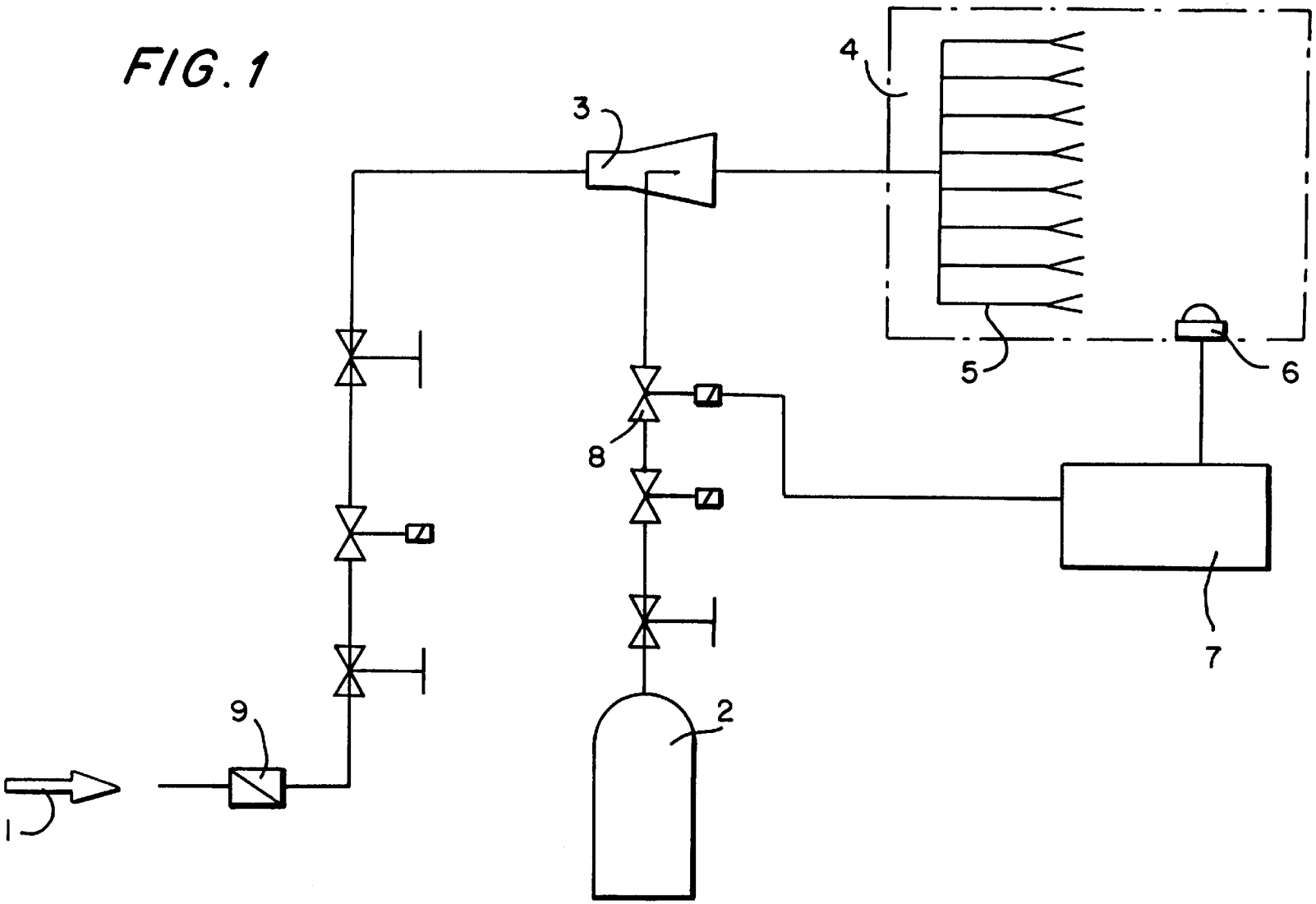
FIG. 1 is a schematic representation of the invention.

The device according to the invention has, along with the usual conduits and suitable blocking devices, a non-return valve (9) arranged at a liquid extinguishing medium supply, preferably water. In preferably mixing unit (3), the liquid extinguishing medium is mixed with a liquid inert gas flowing from a reservoir (2) to form a liquid extinguishing medium mixture. Between the reservoir (2) and the mixing unit (3) are arranged suitable blocking devices and a control valve (8) for controlling flow of the liquid inert gas.

The liquid extinguishing medium mixture is conveyed to a distributing device, such as nozzles (5), so as to produce an atomized spray for extinguishing a fire. An extinguishing area (4) is defined by the aerosol spray. A detector (6) is arranged within the extinguishing are (4) for measuring parameters related to extinguishing of the fire. The detector (6) is connected to an evaluation device (7) which in turn is connected to the control valve (8).

The blocking devices are opened, for example, via a fire alarm unit (not shown) and, after a delay time, in dependence on the water supply, the control valve (8) is switched.

The control valve (8) is switchable to produce intermittent or continuous flow, so as to clear the way for the liquid inert gas as a pressure-increasing and inertizing medium.

The pressure and temperature in the conduit system is determined by ratio of the inert gas and the quantity of extinguishing medium distributed per unit time.

After mixing, during dwelling time in the conduit system, the gas goes in solution in the liquid extinguishing medium due to increased pressure. A volume increase and an increase in pressure thus occurs in the conduit system.

The higher the pressure and the lower the temperature of the liquid extinguishing medium, the more of the liquid inert gas is brought into solution.

A two-phase bubble flow is produced by this process having a mass smaller than that of water. Flow resistance in the conduit network declines, with the advantage that smaller cross-sections can be selected.

Upon emergence from the nozzle and on the path to the fire, the liquid extinguishing medium mixture decomposes into its components, with simultaneous aerosol formation of the liquid extinguishing medium. A large portion of the gas nonetheless makes its way directly into the fire zone without decomposing.

Given optimal projection, or in connection with the detector (6) and the evaluation device (7), the $CO_2$ quantity distributed to the extinguishing area (4) remains below the toxicity limit.

Depending on the nozzle used, the water initially emerges from the conduit system as a jet spray and only breaks down into very fine droplets on its flight to the fire, so that greater ranges can be attained. Alternatively, the water emerges as very fine droplets with a lesser range.

What is claimed is:

1. A device for atomizing water in an extinguisher unit comprising: means for supplying water; reservoir means for storing liquid carbon dioxide; a mixing chamber for mixing the carbon dioxide with the water so as to produce a liquid extinguishing medium mixture, the mixing chamber being configured to produce a bubble flow mixture in which an amount of carbon dioxide injected into the water is sufficiently small such that freezing does not occur and a pressure increase is produced; and the extinguishing unit having means for distributing the liquid extinguishing medium mixture, the distributing means atomizing the liquid extinguishing medium mixture, the mixing means being located before the distributing means.

2. A process for atomizing a liquid extinguishing medium in an extinguisher unit having a nozzle, comprising the step of intermittently adding an inert gas in liquid form to the liquid extinguishing medium, before entering the nozzle, so as to produce a two-phase bubble flow mixture, whereby the inert gas is added at a pressure higher than a pressure of the liquid extinguishing medium.

3. The process according to claim 2, wherein the step of adding the inert gas includes adding $CO_2$ as the inert gas.

4. The process according to claim 2, further comprising the steps of transmitting the two-phase bubble flow mixture through a tubular conduit after adding the inert gas, and atomizing the mixture flowing in the tubular conduit at an exit of the tubular conduit.

5. A process for atomizing a liquid extinguishing medium in an extinguisher unit having a nozzle, comprising the step of adding an inert gas in liquid form to the liquid extinguishing medium, before entering the nozzle, so as to produce a two-phase bubble flow mixture, whereby the inert gas is added at a pressure higher than a pressure of the liquid extinguishing medium, the step of adding the inert gas including adding a quantity of the inert gas which is greater than a quantity of the inert gas which goes in solution with the liquid extinguishing medium.

6. A process for atomizing a liquid extinguishing medium in an extinguisher unit having a nozzle, comprising the step of adding an inert gas in liquid form to the liquid extinguishing medium, before entering the nozzle, so as to produce a two-phase bubble flow mixture, whereby the inert gas is added at a pressure higher than a pressure of the liquid extinguishing medium, the step of adding the inert gas including controlling a quantity of the inert gas added in dependence on a concentration of the inert gas in an extinguishing area.

7. A process for atomizing a liquid extinguishing medium in an extinguisher unit having a nozzle, comprising the step of adding an inert gas in liquid form to the liquid extinguishing medium, before entering the nozzle, so as to produce a two-phase bubble flow mixture, whereby the inert gas is added at a pressure higher than a pressure of the liquid extinguishing medium, the step of adding the insert gas including controlling a quantity of the inert gas added based upon a course of a fire.

8. A device for atomizing a liquid extinguishing medium mixture in an extinguisher unit comprising: means for supplying a liquid extinguishing medium; reservoir means for storing liquid inert gas; means for mixing a liquid inert gas with the liquid extinguishing medium so as to produce the liquid extinguishing medium mixture; the extinguishing unit having means for distributing the liquid extinguishing medium mixture, the distributing means atomizing the liquid extinguishing medium mixture, the mixing means being located before the distributing means; detector means for measuring a concentration of the inert gas in an extinguishing area; at least one evaluation device connected to the detector means; and at least one control valve connected to the evaluation device so as to control the quantity of the inert gas.

9. The device according to claim 8, wherein the mixing means includes a container in which the liquid inert gas is continuously added to the liquid extinguishing medium.

10. A device for atomizing a liquid extinguishing medium mixture in an extinguisher unit comprising: means for supplying a liquid extinguishing medium; reservoir means for storing liquid inert gas; means for mixing a liquid inert gas with the liquid extinguishing medium so as to produce the liquid extinguishing medium mixture; the extinguishing unit having means for distributing the liquid extinguishing medium mixture, the distributing means atomizing the liquid extinguishing medium mixture, the mixing means being located before the distributing means; and detector means for determining the course of a fire so as to control extinguishing of the fire.

11. A process for atomizing a liquid extinguishing medium in an extinguisher unit having a nozzle, comprising the steps of: adding an inert gas in liquid form to the liquid extinguishing medium, before entering the nozzle, so as to produce a two-phase bubble flow mixture, whereby the inert gas is added at a pressure higher than a pressure of the liquid extinguishing medium; transmitting the two-phase bubble flow mixture tubular conduit at an exit of the tubular conduit, the atomizing step including atomizing with an extinguishing nozzle having a controllable opening angle and controlling the opening angle in dependence on a location of a fire, a course of a fire and an amount of pressure at the extinguishing nozzle.

12. A device for atomizing a liquid extinguishing medium mixture in an extinguisher unit comprising: means for supplying a liquid extinguishing medium; reservoir means for storing liquid inert gas; and means for mixing the liquid inert gas with the liquid extinguishing medium so as to produce the liquid extinguishing medium mixture, the extinguisher unit having means for distributing the liquid extinguishing medium mixture, the distributing means atomizing the liquid extinguishing medium mixture, the mixing means being located before the distributing means, the distributing means including adjustable opening angles adjustable in dependence on a quantity of the insert gas in the liquid extinguishing medium mixture.

* * * * *